US005079088A

United States Patent [19]

McGroarty et al.

[11] Patent Number: 5,079,088

[45] Date of Patent: * Jan. 7, 1992

[54] WATER BARRIER

[75] Inventors: Bryan M. McGroarty; Patrick J. McGroarty, both of Bloomington, Minn.

[73] Assignee: Paramount Technical Products, Inc., Spearfish, S. Dak.

[ * ] Notice: The portion of the term of this patent subsequent to Sep. 15, 2004 has been disclaimed.

[21] Appl. No.: 671,678

[22] Filed: Mar. 19, 1991

Related U.S Application Data

[63] Continuation of Ser. No. 349,981, May 8, 1989, abandoned, which is a continuation of Ser. No. 89,311, Aug. 25, 1987, abandoned, which is a division of 801,007, Nov. 22, 1985, Pat. No. 4,693,923.

[51] Int. Cl.[5] ..... B32B 5/16; B32B 9/00; B32B 13/12; B32B 19/00

[52] U.S. Cl. ..... 428/331; 52/169.14; 52/232; 52/408; 52/515; 264/69; 264/112; 264/113; 427/208.8; 428/148; 428/149; 428/150; 428/328; 428/329; 428/337; 428/451; 428/701; 428/913

[58] Field of Search ..... 264/69, 70, 112, 113; 52/169.14, 408, 515, 232; 427/202, 203, 204, 208.8; 156/62.2, 538; 428/331, 451, 148-150, 337, 913, 328, 329, 701

[56] References Cited

U.S. PATENT DOCUMENTS

| | | | |
|---|---|---|---|
| 1,052,245 | 2/1913 | Hackworth | 264/256 X |
| 1,552,421 | 9/1925 | Cumfer | 427/204 X |
| 1,823,238 | 9/1931 | Campbell | 427/202 X |
| 1,913,475 | 6/1933 | Conant | 427/204 X |
| 1,913,667 | 6/1933 | Harshberger | 264/256 X |
| 2,137,308 | 11/1938 | Rahr | 427/202 X |
| 2,603,575 | 7/1952 | Schramm, Jr. | 117/60 |
| 3,012,901 | 12/1961 | Reese | 264/70 X |
| 3,186,896 | 6/1985 | Clem | 161/133 |
| 3,246,064 | 4/1966 | Moore et al. | 156/62.2 X |
| 3,445,322 | 5/1969 | Saiia et al. | 52/169.14 X |
| 3,461,016 | 8/1969 | Irving, Jr. et al. | 156/62.2 X |
| 3,466,827 | 9/1969 | Clem | 52/446 |
| 3,561,177 | 2/1971 | Agro et al. | 52/169.14 X |
| 3,676,198 | 7/1972 | McGroarty | 117/105.5 |
| 3,681,157 | 8/1972 | Smock | 156/62.2 |
| 3,754,065 | 8/1973 | Hofmann et al. | 264/70 |
| 3,896,969 | 7/1975 | Basile | 206/219 X |
| 3,949,560 | 4/1976 | Clem | 61/36 R |
| 4,021,402 | 5/1977 | Clem | 260/42.12 |
| 4,022,211 | 5/1977 | Timmons et al. | 604/375 X |
| 4,048,373 | 9/1977 | Clem | 428/454 |
| 4,049,121 | 9/1977 | White | 206/459 X |
| 4,070,839 | 1/1978 | Clem | 52/448 |
| 4,084,382 | 4/1978 | Clem | 61/36 R |
| 4,103,499 | 8/1978 | Clem | 61/50 |
| 4,126,543 | 11/1978 | Clem | 209/263 |
| 4,128,688 | 12/1978 | Wiley | 428/159 X |
| 4,139,588 | 2/1979 | Clem | 264/232 |
| 4,194,970 | 3/1980 | Clem | 209/263 |
| 4,212,691 | 7/1980 | Potosky | 156/79 |
| 4,231,370 | 11/1980 | Mroz et al. | 604/361 |
| 4,326,094 | 4/1982 | Hunn | 174/116 X |
| 4,367,057 | 1/1983 | Hughes et al. | 405/267 |
| 4,430,027 | 2/1984 | Hughes et al. | 405/267 X |
| 4,467,015 | 8/1984 | Clem | 428/454 |
| 4,529,625 | 7/1985 | Reidenbach et al. | 427/204 X |
| 4,534,926 | 8/1985 | Clem | 264/281 |
| 4,565,468 | 1/1986 | Crawford | 405/270 |
| 4,581,864 | 4/1986 | Shvakhman | 52/169.14 |
| 4,584,210 | 4/1986 | Previsani | 427/204 |
| 4,656,062 | 4/1987 | Harriett | 427/397.7 X |
| 4,693,923 | 9/1987 | McGroarty et al. | 427/208.8 |
| 4,775,567 | 10/1988 | Harkness | 52/169.14 X |

FOREIGN PATENT DOCUMENTS

| | | | |
|---|---|---|---|
| 38-16334 | 8/1963 | Japan | 264/256 |

*Primary Examiner*—Jan H. Silbaugh
*Assistant Examiner*—Karen Aftergut
*Attorney, Agent, or Firm*—Kinney & Lange

[57] ABSTRACT

A waterproof sheet used to waterproof structures has a single layer of non-degradable, water impermeable polymeric membrane that has layers of particles of non-hydrated sodium montmorillonite (sodium bentonite) adhering to the membrane in a uniform layered thickness. The layers of particles of sodium montmorillonite spaced from the membrane adhere to each other, with a coating material (adhesive) that is designed to provide the necessary performance for waterproofing. A water soluble dye is provided in the layer of particles so if a tear occurs in the impermeable membrane and water contacts the particles, the dye will stain the membrane and mark the location of the tear.

6 Claims, 2 Drawing Sheets

WATER BARRIER

CROSS REFERENCE TO RELATED APPLICATION

This is a continuation of application Ser. No. 07/349,981 filed on May 5, 1989, (now abandoned), which was a continuation of application Ser. No. 07/089,311, filed Aug. 25, 1987 (now abandoned), which is a division of Ser. No. 06/801,007, filed Nov. 22, 1985, now U.S. Pat. No. 4,693,923.

BACKGROUND OF THE INVENTION

1. Field of the Invention

The present invention relates to waterproofing processes and materials, and in particular a sheet laminated with non-hydrated granular bentonite for applications for waterproofing.

2. Description of the Prior Art

Various bentonite type waterproofing panels have been advanced in the past. In particular, American Colloid Company, of Skokie, Illinois has obtained numerous patents on various water barrier panels, but they all have limitations in use. Generally speaking, these panels are easily damaged, and lose their ability to function if not handled carefully. A typical water barrier panel is shown in U.S. Pat. No. 4,048,373 which comprises two opposing spaced sheets using a sealing composition between the sheets that has bentonite in it, with a water soluble dispersing agent. This type of a panel is used against a foundation to act as a water barrier shielding the foundation, and is essentially a corrugated paper board carrier filled with finely granulated bentonite. This patent does describe the well-known waterproofing characteristics of bentonite, but the structure disclosed fails to provide the durability and adaptability of the present device.

U.S. Pat. No. 4,048,373 is a continuation in part of U.S. Pat. No 3,949,560 which includes substantially the same disclosure, and a divisional patent U.S. Pat. No. 4,103,499 also shows the same type of a water barrier panel. Related U.S. patents, from the same family of applications, include U.S. Pat. Nos. 4,021,402 and 4,139,588.

American Colloid Company also has two additional related U.S. Pat. Nos. 4,126,543 and 4,194,970 which show a method of screening bentonite material for use in obtaining correct size bentonite particles. These patents do not show waterproofing panels as such.

U.S. Pat. No. 3,186,896 shows a facing sheet quite similar to that described in the prior patents, comprising a barrier panel made of corrugated paper board that is filled with bentonite.

U.S. Pat. No. 4,084,382 relates to a method for containing water having a high concentration of water soluble industrial wastes to reduce the likelihood of the wastes destroying the bentonite used. The bentonite is mixed with a water soluble dispersing agent and a water soluble polymer in a particular ratio to form a sealing compound.

U.S. Pat. No. 3,466,827 shows a roof panel that is formed to provide impervious construction, and is a self-sealing panel using a finely divided soluble bentonite clay in a layer.

U.S. Pat. No. 4,070,839 shows a moisture impervious panel that has a pair of spacing sheets interconnected by a central rigid support sheet, such as corrugated fiberglass. The corrugated sheet forms long pockets filled with a composition of bentonite and a compressed filler such as vermiculite. This construction forms a very rigid panel that is not usable in any form other than smaller sheets, and does not have sufficient flexibility to accommodate any substantial shifting of the surfaces that the panels are covering.

U.S Pat. No. 4,467,015 shows another type of structure that has two layers, and which can be formed into a roll. Each layer includes a sheet of water permeable material and a coating of dry particles of bentonite on one surface of the sheet. An adhesive is used for applying the particles of bentonite to the water permeable material, and the bentonite particles are placed so that they face the surface of the structure that is to be waterproofed. The sheet shown in U.S. Pat. No. 4,467,015 has inherent problems with the cardboard or water permeable sheet, namely migration of water and leaking at the joints until the material attempts to self-seal. The material also is susceptible to rain damage and it needs protection against the weather when installed, until it is covered by backfilling or the like.

U.S. Pat. No. 3,676,198 shows apparatus for entraining bentonite particles in an air stream, and intermixing the particles with a coating material to cause the mixture to adhere in a layer onto a wall surface 11, and provide for a waterproofing layer in that manner. The patent requires special on site installation equipment.

U.S. Pat. No. 4,534,926 shows an uninhibited bentonite composition which comprises an intimate mixture of bentonite clay with polypropene, polybutene or mixtures thereof. The material is capable of being extruded through an extrusion die and further a sheet like material can be put between two release papers, but still has to be formed through an extrusion die that has a wide opening to form a type of sheet.

Thus, while the prior art shows various attempts at forming panels that use bentonite for waterproofing, and even though the desirable properties of bentonite for waterproofing have been known, the problems remain in obtaining a waterproofing sheet that is easily used; that withstands weathering; that seals leaks and seals well at joints and will continue to provide waterproofing over a span of time.

SUMMARY OF THE INVENTION

The present invention relates to a waterproofing sheet and method of using the same wherein the sheet is made of an impervious flexible material or membrane (impervious to water), and has a layer of granular bentonite adhering to one surface thereof. The bentonite particles also adhere to each other to form the layer that has structural integrity sufficient to permit the sheets to be rolled or handled as large sheets.

In one form shown, the two intersecting margins (one side and one end) of a sheet are made so that there are no particles for a short distance along the edges of the polymeric sheet, to provide for a sealing overlap of one edge of the membranes onto the edge of a second sheet of the membrane. This provides seal lines that can be caulked, welded or adhesively sealed, to create a tight cover of panels over the structure. The water impervious membrane provides a primary line of waterproofing, and if, for example, the membrane gets pierced, the water penetrates into the bentonite layer and the bentonite will expand into the ruptured membrane opening to form a seal. Water soluble dyes can be added to or incorporated into the bentonite to assist in the identification of the area of a leak because as water enters the bentonite, the dye will dissolve and the leaking water will then stain the leak area to make it visible, even after the problem areas have been back filled or covered. Repairs to the membrane rips or tears can then be made.

Many polymeric materials which are currently not in use as above grade roofing or below grade waterproofing products because of the great difficulty in causing them to adhere to the building wall or substrate can now be used because the bentonite layer when wet holds the membrane in place as well as providing additional waterproofing characteristics. Polymers such as high density polyethylene and polypropylene can be used for the membranes in the present device. Further, chlorinated polyethylene, polyvinylchloride, neoprene and butyl sheets can also be used and by adding the layer of bentonite the sheet composite becomes self-sealing, anti-water migration roofing material without the expensive necessity of fully gluing the membranes in place on the building surface.

The present invention utilizes a layer of water impermeable polymer, and is usually installed polymer side out. The bentonite is protected from rain damage by the polymer when it is put into place. If a tough polymer is used, such as high density polyethylene, a product that is not susceptible to damage is achieved.

The bentonite layer eliminates the need for tightly adhering a membrane to the wall or roof structure to stop water migration, because if water tends to get under the membrane and contact the bentonite, the bentonite is self-sealing and swells to stop any migration immediately. Water migration between membranes and a substrate has been a cause of great unsatisfaction of users of buildings, and has been the cause of innumerable lawsuits.

Again, the present invention permits identifying the source of damage to the membrane, and the bentonite layer provides for self-sealing immediately.

As disclosed herein, an apparatus for manufacturing the waterproofing sheet composites is disclosed which provides for individually adhering single particle thick layers onto the membrane, with a layer of adhesive, and then subsequently adding additional single particle thick layers until the desired depth of the particles is achieved. The backing membrane, as disclosed high density polyethylene, is carried on a conveyor up an incline, and a spray bar is positioned to apply a thin layer of adhesive directly to the polyethylene membrane. The adhesive is selected to be one that adheres to the membrane, and a wide range of adhesives will work. Then, as the membrane moves along with the conveyor, a single particle thick layer of bentonite particles is deposited on the adhesive above a conveyor-membrane agitator that provides a frequency of vibration to the conveyor in a direction perpendicular to the conveyor belt so that the particles tend to dance upwardly and form a standing wave of particles that lift from the belt and tend to fall downwardly under gravity. The conveyor belt is inclined upwardly in its path of travel, and the particles tending to move downwardly will fall into place on the adhesive layer and will be held in place in a single thickness of particles. The rate of feed of the bentonite particles can be controlled in a conventional manner so that excessive particles are not provided. A uniform single particle thick layer is thus provided on the membrane.

The conveyor moves the membrane to a second station where an additional thin layer of adhesive is sprayed onto the previously deposited layer of particles, and then another layer of particles is deposited on the second layer of adhesive, in the same manner as described. The second layer of particles increases or doubles the thickness of the particles on the membrane, and this process is repeated in sequence until a desired depth has been deposited on the membrane.

The membrane formed into the composite waterproofing sheet is carried on the conveyor belt downwardly, and can be passed through sizing rollers that will compress the layers of particles into the adhesive to insure good adherence as well as a uniform thickness of the finished product.

The finished composite waterproofing sheet product is then placed into rolls for storage and shipment to the job site, where it is installed as described above or is cut into individual panels of desired size. The method of manufacture makes it possible to provide rapid and accurate formation of the bentonite layers, thereby increasing efficiency.

DESCRIPTION OF THE PREFERRED EMBODIMENTS

Figure 1:
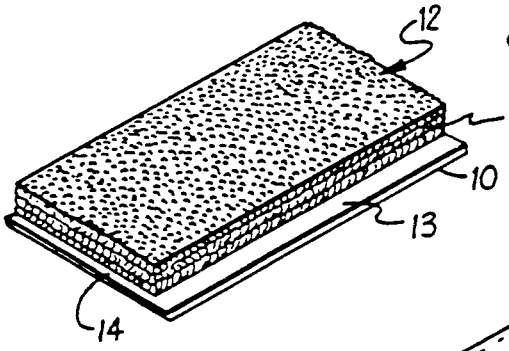
FIG. 1 is a fragmentary perspective view of a composite waterproofing sheet made according to the present invention.

FIG. 1 illustrates a finished composite waterproofing sheet product 12, made according to the present invention and comprises, preferably a membrane 10 of material that is impervious to water, such as high density polyethylene, and a thickness or waterproofing layer of bentonite or sodium montmorillonite indicated at 11.

It is to be understood that the layer 11 is meant to indicate a finished thickness of bentonite made up of a number of layers, each having a thickness of an individual bentonite particle with interspersed adhesive layers, made into a sandwich type composite waterproofing sheet 10.

Figure 2:
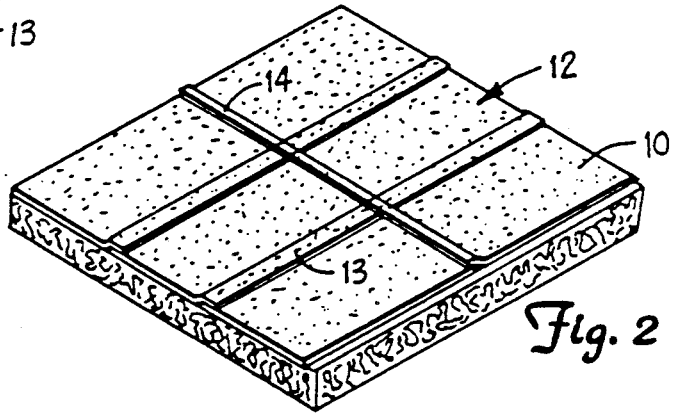
FIG. 2 is a perspective view a typical wall showing the composite waterproofing sheets made according to the present invention formed into individual panels in place, with overlapping seam edges to illustrate the multiple panels installed on a large wall.

In manufacture, an edge portion 13 of the membrane or sheet 10 may be left without the layer 11 of particles, as shown in FIG. 2, so that the sheets or panels can be lapped. The lapping edge portion 13 in FIG. 2 along a longitudinal edge, and if smaller panels such as four foot by four foot panels are used, an edge portion 14 of the membrane will be left uncoated along one end of the panel as well. In this way the panels (or long strips or sheets) can be lapped where they meet, for holding them together when initially installing them, and also to permit the seams to have a continuous impervious membrane layer facing out from the surface. It should be noted that the composite waterproofing sheets are installed with the water impervious membrane facing outwardly to the elements.

Thus the composite structure comprises a flexible water impervious membrane in sheet form having a layer of particles, for waterproofing, preferrably bentonite particles, on the surface at a desired depth.

Adhesives that provide proper holding action are also important. While the prior art shows various adhesives that will work with bentonite, bentonite is highly reactive to many monovalent, divialent and trevalent materials. Bentonite also may form a permanent association with numerous other elements and compounds, and such products should be avoided in making the composite waterproofing sheets so that the bentonite particles do not react and lose their desirable property of swelling when contacted by water. When reactions do occur, or association of the bentonite particles with other elements occur, the waterproofing capabilities are degraded, because the bentonite material does not have the ability to swell and waterproof. The choice of adhesive is carefully made for making the composite waterproofing sheet 10, the adhesive has to have the ability to adhere the bentonite particles to a polyethylene or other water impervious membrane, and minimize the degradation of the waterproofing capabilities of the bentonite. Adhesive materials are available as emulsions with water, solutes, concentrates, hot melts and often in homo or copolymer status. Almost any adhesive originating from a solvent, emulsion with water, hot melt or water emulsified solid may be used, and the choice is determined by the ability to wet, its stickiness, the polar activity and the final adhesion performance. The choice is influenced by price, toxicity, availability, or environmental considerations as well. The addition of wetting agents, emulsifiers, dispersants and preservatives for latexes can cause deterioration of the bentonite's ability to waterproof or reseal, so use of those products may be minimized.

Adhesion to high density polyethylene has been difficult, and a common procedure to enhance adhesion is to chemically disturb the surface of the polyethylene or polymer membrane just prior to the application of the adhesive, for example by treating it with ozone. This brings in time limitations which means that the membrane has to be coated quite quickly because the molecules that are affected by the treatment migrate back to their original smooth alignment relatively fast.

The total thickness of the layers of bentonite particles is built up to in the range of ⅛ inch to ¼ inch thick, and thus a method of continuously achieving a permanent adhesion to the polyethylene membrane is required. The surface of the polyethylene preferrably is roughened, and as shown herein, it can be done by stretching the polyethylene to microscopically "craze" the surface of the polyethylene. The amount and the direction of the tension applied to the membrane is determined by the thickness of the membrane. Generally, tensioning the membrane to about 30 lbs per square inch is acceptable for thicknesses of 2 to 20 mils. The membrane used herein is most preferably in the range of 20 mils, but the preferred range is 15 to 100 mils in thickness. As will be explained, tensioning can be done by passing the polyethylene membrane over rollers which apply a stretch between pinch drive rollers.

The adhesive used must wet the polyethylene surface for good adhesion, and low surface tension solvent systems provide a suitable vehicle to carry the adhesive.

Alaphatics, aldehydes, ketones, carbon/halide and ring compounds all have utilization. Common carriers/-solvents include toluene, lower molecular weight alcohols, methyl ketone, and water. For example, the following products act as suitable adhesives.

Asphalts (with or without fillers and elastomers)
Butylenes
Butyl Rubber
Acrylics
Propenes
Styrene/butadiene
Nitriles
Vinyls
Water Soluble:
Cellulosics
Saccharides
Gums
Proteins.

In general, the adhesive solids should be present in concentrations from about 5 to 100% by weight, and are mixed with bentonite in ratios of between 3 and 50% by weight of the adhesive relative to the particles (bentonite).

Figures 3, 6:
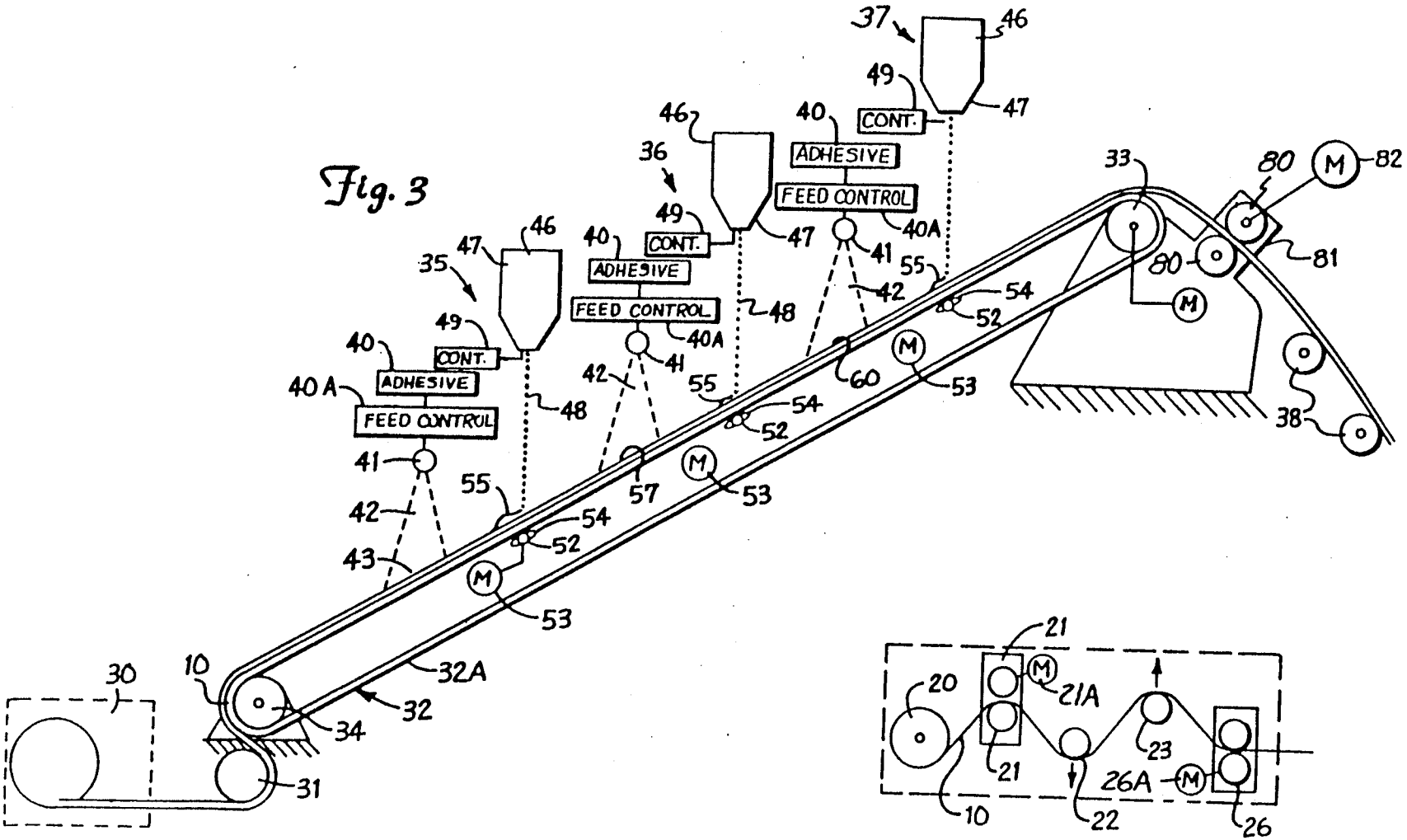
FIG. 3 is a schematic representation of a machine for manufacturing composite waterproofing sheets made according to the present invention.
FIG. 6 is a schematic representation of apparatus for applying tension into a membrane to stretch it before adhesive is applied, which can be used as an introductory station to aid in insuring that the adhesive wall adhere to polyethylene for example.

Referring specifically to FIG. 6, the method of prestretching the polyethylene for applying the adhesive is illustrated schematically, and is a conventional method for stretching sheets of materials. The structure shown therein can constitute the polyethylene supply for the main machine which will be discussed. A roll of polyethylene membrane material or other suitable sheet material is indicated at 20, and the membrane is passed through a pair of pinch rollers 21, which are driven from a motor 21A at a first speed and clamp the polyethylene membrane so it is driven at this set rate. The polyethylene is then run over suitable tensioning rollers indicated generally at 22 and 23 (more tensioning rollers may be used), and then the membrane is passed through a pair of pinch drive rollers 26. The drive rollers 26 are also driven by a suitable motor 26A, and tension can be applied to the membrane by driving the rollers 26 at a different (faster) lineal speed than the rollers 21. The membrane will be tensioned because of the differential in speed.

Another way of stretching the membrane would be to run a section of sheet material between the first and second sets of pinch rollers, and then move the rollers, or guide rollers 22 and 23, in opposite directions (indicated by arrows) to stretch the membrane 10 a desired amount, and then subsequently run an additional length of material onto the stretching idler rollers. However, in a continuous process, the method of tensioning or stretching the polyethylene membrane (or other membrane) can be used applying known principles, and thus the showing is done only schematically herein. Additionally, treated polyethylene can be obtained that has the ozone treatment previously mentioned.

FIG. 3 illustrates schematically the method of applying adhesive and particles to the water impervious membrane. The material supply indicated generally at 30, which can comprise a roll, if the membrane is treated, or the stretching rollers and drive shown in FIG. 6, provides a continuous sheet of the membrane 10 that passes over a guide roller 31, and then is fed onto the top of a conveyor belt assembly indicated generally at 32 having an endless belt 32A. As shown, the conveyor belt assembly is schematically represented as having a drive roller 33 at its upper end, and an idler roller 34 at its lower end over which the belt 32A is mounted. The conveyor belt 32A and thus the membrane sheet 10 are inclined in the range of 20° to 50° with respect to a horizontal plane. The conveyor belt incline is matched with a downwardly extending conveyor section 38 that may be rollers or a conveyor belt and which is shown only partially, on which the membrane sheet 10 will run after the particles have been applied to form the composite waterproofing sheet 12. The downward incline is to insure that the membrane 10 will be carried upwardly by the conveyor belt 32A because there will be a downward component of loading tending to keep the membrane 10 moving upwardly on the incline. There will be some friction between the conveyor and the undersurface of the membrane as well. If needed, drive rollers can be utilized. The conveyor belt can be open mesh, a rubber coated belt or any desired construction.

Figure 4:
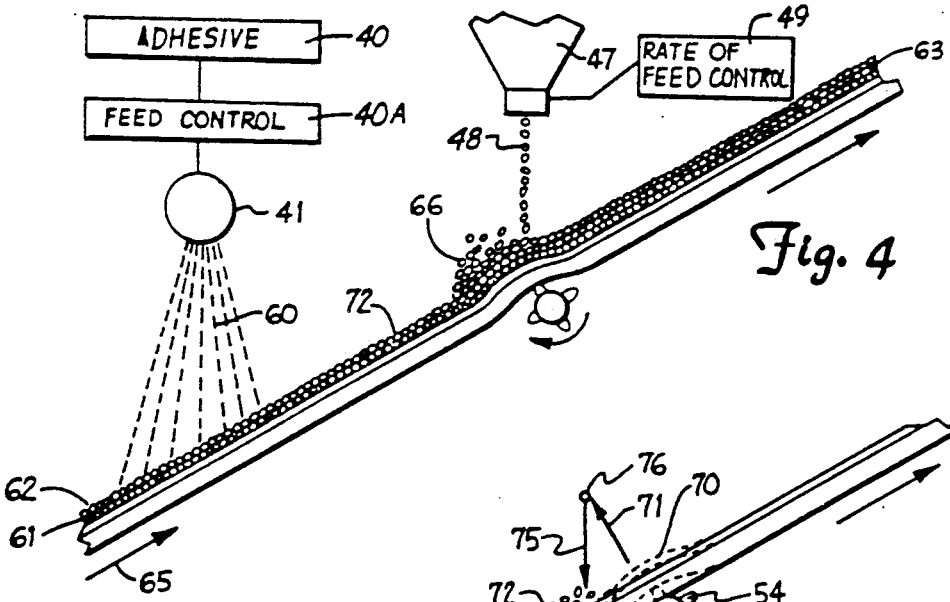
FIG. 4 is an enlarged view showing one of bentonite application stations, shown in FIG. 3, and illustrating the method of vibrating a conveyor belt in order to obtain a uniform layer of bentonite particles.
Figure 5:
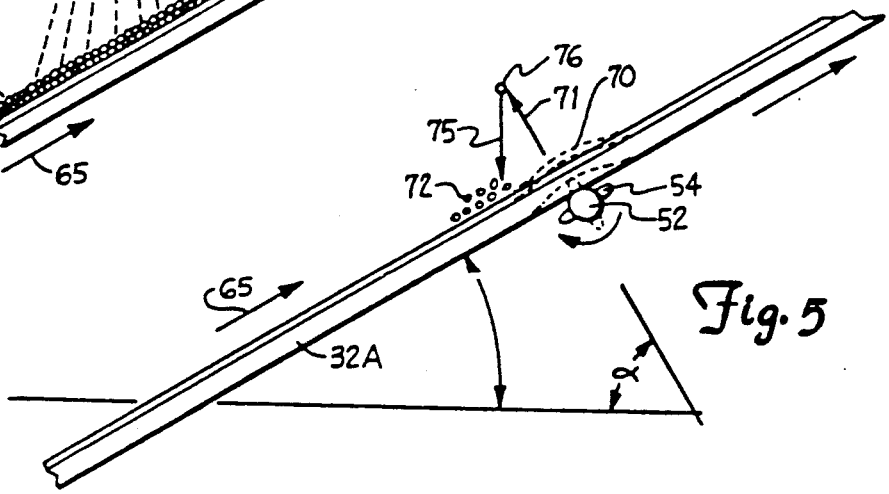
FIG. 5 is a force vector representation of the bentonite particle paths in relation to the forces applied to the belt by the beater.

The membrane sheet 10 has a surface that faces upwardly and as it is carried up the incline, the membrane 10 passes through a first particle application station indicated generally at 35, a second station indicated generally at 36, and a third station indicated generally at 37. More application stations are generally used, but the stations illustrated show the method. Each station 35, 36 and 37 includes an adhesive supply 40 feeding an adhesive through a feed control 40A to a spray bar 41 that extends transversely across the width of the membrane sheet 10. If the membrane is in the range of 4 feet wide, the adhesive bar would be that long. Known adhesive spray bars can be utilized. The adhesive used can be selected from the group previously listed, and as shown by the dotted line representations at 42, the adhesive is sprayed in a thin layer onto the moving membrane in a first processing region indicated generally at 43. The coated membrane 10 moves upwardly a distance on the inclined conveyor, and a second portion of the station 35, comprising a bentonite hopper 46 having a transversely extending feed section 47 of conventional design also controlled as to rate of feed with a conventional rate of feed control 49 applies a uniform, relatively thin line of bentonite particles indicated at 48 across the membrane. The bentonite particles drop onto the conveyor, immediately above or in the vicinity of a rotating beater bar 52 that is mounted in a suitable manner on bearings at opposite ends and is driven from a motor 53 to rotate at a desired speed. The beater bar 52 has two radial longitudinal extending lugs 54 on opposite sides thereof (diametrically opposed). Two positions of the lugs are shown in FIGS. 4 and 5, one in dotted lines. The lugs 54 strike the conveyor belt on its undersurface and vibrate it upwardly to bounce the bentonite particles upwardly from the belt and the membranes (at least particles that have not initially adhered to the layer of adhesive) and the loose particles then will tend to fall back into the region shown at 55 in FIG. 3. A type of "standing wave" of individual particles is created because they will tend to fall back onto the membrane and be replaced by new particles bounced in the air by the beater bar. The particles which have touched the adhesive move upwardly with the membrane, but are locked in place.

This low frequency, vertical vibrating action dislodges nonadhered bentonite particles, and insures that a totally adhered, uniform single particle thick layer is applied to the first adhesive layer in station 35.

As the conveyor belt 32A and membrane sheet 10 move through the second station 36, the layering action is repeated. The second sprayer bar 41 applies a thin layer of adhesive in a region shown at 57, which would be applied on the upper surface of the first layer of bentonite particles, as well as flowing slightly in between any spaces in the bentonite particles forming the first layer. The rate of feed of adhesive can be controlled with feed control 40A. A second bentonite hopper 46 with a feed assembly 47 and rate of feed control 49 will apply another individual particle layer onto the first layer of particles and the second layer of adhesive applied in the region 57. The hopper 46 at the second station 36 is also immediately above a beater bar 52 that is driven from a motor 53 as well. This beater bar acts as before and forms a second standing wave or particles to cause a second, single particle thick layer of particles to form on top of the first layer of particles, so that now there are two layers of particles adhered to the upper surface of the membrane 10.

In the third station 37, the same action occurs, and here the adhesive is applied in a section 60 of the membrane. A third layer of adhesive is applied in section 60 with a third spray bar 41, and when the applied thin layer of adhesive is moved up under the third station bentonite hopper 46, the feed of particles from the feed section 47 of the third station 37 falls down onto the new or fresh adhesive layer to form a third layer of particles on the membrane. The particles are deposited above a third beater bar 52 driven from a motor 53 to form a standing wave 55 at station 37, forming the uniform, single particle depth third layer of material.

The number of layers of particle material desired, to achieve the desired thickness determines the number of individual stations that are utilized. This process may be used for forming adhering layers of particles to membranes or sheets for various uses, such as single layer sandpaper or nonslip pads, as well as for waterproofing sheets.

FIG. 4 illustrates in greater detail the individual layers of particles indicated at 61, 62 and 63, which would be applied after the adhesive station in the region 60 of the membrane. The conveyor belt movement direction is indicated by the arrow 65, and it can be seen that the beater bar forms a standing wave section shown at 66 where the particles tend to make a loop, and the particles that are falling rearwardly will fall down onto the adhesive from the spray bar that applies the adhesive in the area 60 and to retain a single particle thick layer. The adhesive layer is controlled in thickness to accomplish this purpose.

FIG. 5 illustrates the forces and the amplitude of movement caused by the beater 54. The conveyor belt and membrane deflect upwardly as shown in dotted lines at 70, tending to throw or project the particles upwardly from the belt as shown by the arrow 71. The particles then fall under gravity generally downwardly, at the same time the conveyor belt and membrane are moving upwardly in the direction as indicated by the arrow 65, so that the adhesive coated particles indicated generally at 72, with the fresh layer of adhesive on top will collect the next layer of particles to form the uniform depth layers.

The upward force vector is shown by the vertical arrow 71, gravity is shown by the arrow 75, and the individual particle indicated at 76 is falling in direction along the arrow 75 as a direction of return. A standing wave again is shown generally at 66 where the particles tend to loop over and adhere to the adhesive.

The sequence is applying adhesive, and a uniform single particle thick layer across the surface of the membrane sheet of material (leaving an edge portion for the lap seam shown in FIG. 2) and then applying a uniform layer of particles above a vibrator or beater, so that the particles adhere as the material is moved in an upwardly inclined plane. Additional layers are added at additional, individual stations positioned in sequence along the inclined membrane.

Nonadhering particles are problems in an adhesive layer, and in the present device, non-adhering particles would act as a bond breaker, or separation with subsequent layers. Such condition (non-adhering particles) causes delamination and separation which leaves the waterproofing sheet unsuitable for use. It could not be transported, handled for installation, nor provide proper waterproofing qualities. The method described, using the beaters, insures that every particle is tested to insure it is fully adhered to the adhesive before a new layer is added. The apparatus performs in situ testing of the particle bonds.

Large particles applied in a single layer and premixing the adhesive with the particles does not form a uniform thickness, leaves voids and spaces, and separates when folded around outside corners of a structure. Another way of attempting to add particles to a membrane has been to wet the membrane with adhesive and then pull it through a supply of particles. This wipes off adhesive and generally is unsatisfactory.

The present process shown utilizes a minimum amount of adhesive, with a controlled ratio of adhesive to particles. Because a fresh layer of adhesive is applied at each station, dry areas are prevented and a uniform thickness is achieved. Particle size of bentonite can range up to 150 mesh, using standard mesh sizes for bentonite. The beater tends to cause the unattached particles to become airborne, and the loose particles will continue to be forced back into the adhesive to form the standing wave explained.

The ratio of adhesive to particles is easily controlled by the size of the nozzles, pressure and the spray bar, as well as the rate of feed of the particles. Two to 12 pounds of adhesive to 40 pounds of particles is a range that is generally satisfactory, and it should be pointed out that if too much adhesive is used, it will tend to flow downwardly and not be carried up the incline. The dry particles are kept airborne by the beaters, so that they will not pass through the station until they have lodged in adhesive and adhere in a desired layer.

The particle size can be between 5 and 150 mesh using standard U.S. standard mesh sizes. If desired air entraining of particles (fluidizing) can be used for feeding the particles. Lowering the amplitude and frequency of the beater bar at the final station will cause the production of a dry particle coating over the entire layer, which would tend to have a little less adherence, but it would be an immediate physical state for packaging. The beater bars generally in the final station would have an amplitude of about ⅛ of an inch with a frequency of about 100 rpm (200 beats per minute). The amplitude of the "beat" is limited by the force of gravity, i.e. how fast does the conveyor belt resume its original position before being "hit" again by the rotating beater.

In the other stations, the amplitude of the beater bar and the rotational velocity of the beater in relation to linear velocity of the conveyor belt is selected to be proper for the angle of inclination of the conveyor belt. For example, an amplitude of the beater of a ⅛ inch rotating at 180 rpm, when the velocity of the conveyor belt is approximately 25 feet per minute with an angle of incline of 30° results in the bentonite particles being knocked back about two inches so that the standing wave develops in an area of the membrane about two inches behind the beater bar. The particles returning from the area of beating, plus the newly supplied particles provide the uniform coating that sticks to the adhesive. The coating or composite layer of bentonite preferably ranges between 0.75 pound and one pound per square foot for adequate waterproofing capabilities.

The coating or composite layer of bentonite is built up to a weight of about one pound per square foot for adequate waterproofing characteristics for the composite waterproofing sheet 12.

As part of final sizing, compression rollers 80,80 are shown. These rollers are mounted on a frame 81 and driven with a motor 82 at a desired speed, syncronized with the membrane speed of movement. The rollers 80 extend across the composite sheet and compress the membrane layers of bentonite particles together to provide a uniform depth layer and to force the particles to be sealed in adhesive.

Water soluble (miscible) colorants may be added to the bentonite layer. When present, these colorants dissolve in the water and make a stain when water leaks through any damage such as a rip or tear in the nonpermeable membrane 10, thus clearly marking the size, location and origin of the leaking water.

This capacity is especially valuable on horizontal surfaces such as roofs, decks, plazas, etc. This feature could not be used if the membrane were not impermeable to the passage of water.

Common water miscible soluble dyes such as used in easter eggs (non-staining) or tracing dyes which are used in extremely small quantities such as the ultraviolet flourescent family i.e. the dye material sold by E. I. du Pont de Nemaurs & Co. Inc.) under the mark "FLOURESENE", would also be suitable.

The mechanical components and conveyors may be suitable, commercially available components and thus the spray bars, hoppers and rollers are shown only schematically.

This invention makes possible a waterproofing installation to the substrate under a floor prior to the concrete pour. It would be installed bentonite side facing the earth with each sheet overlapped along its edges as explained.

Although the present invention has been described with reference to preferred embodiments, workers skilled in the art will recognize that changes may be made in form and detail without departing from the spirit and scope of the invention.

What is claimed is:

1. A waterproofing sheet composite comprising:
   a membrane of water impermeable material; and
   a water expandable layer of particles which expand when contacted by water on a side of the membrane opposite the side which is exposed to external elements, to waterproof tears in the impermeable membrane by expansion of the particles from water leaks, the layer of particles including a sufficient amount of water soluble dye so that when a tear of the water impermeable membrane occurs and water contacts the water expandable layer from the side of the membrane exposed to external elements, the dye dissolves and indicates such tear by staining the water impermeable membrane to mark the location of the tear.

2. A waterproofing sheet of claim 1, wherein:

the layer of particulate material comprises bentonite particles which expand in the presence of water, and means for holding the bentonite particles in the layer, the water soluble dye being provided in the layer of bentonite particles.

3. The waterproofing sheet of claim 2, wherein:

the particles are held onto the membrane of water impermeable material and are held to each other with an adhesive material.

4. A sheet that is used for waterproofing a wall having an exterior surface wherein:

the sheet comprises a membrane of water impermeable material having an exterior surface;

a layer of bentonite particles on a side of the membrane so the bentonite particles are between the membrane and the wall surface, the layer of bentonite particles comprising a granular material that swells in the presence of water to cause a waterproofing action to fill in cracks and leaks;

a liquid soluble dye included in the layer of particles in a sufficient amount so that when a tear is present in the water impermeable membrane, the dye dissolves int eh water contacting the dye through the tear from the exterior surface and provides a stain on the exterior surface of the water impermeable membrane indicating the location of the tear.

5. The sheet of claim 4, wherein the layer of bentonite particles comprises individual bentonite particles adhered to each other, and to the membrane by an adhesive material coating the particles.

6. The sheet of claim 5, wherein the particles are built up in individual layers.

* * * * *

UNITED STATES PATENT AND TRADEMARK OFFICE

CERTIFICATE OF CORRECTION

PATENT NO. : 5,079,088

DATED : January 7, 1992

INVENTOR(S) : Bryan M. McGroarty et al.

It is certified that error appears in the above-identified patent and that said Letters Patent is hereby corrected as shown below:

Col. 11, line 1, delete "the" and insert --said--.

Col. 12, line 10, delete "int eh" and insert --in the--.

Signed and Sealed this

Twentieth Day of April, 1993

*Attest:*

MICHAEL K. KIRK

*Attesting Officer*

*Acting Commissioner of Patents and Trademarks*